US010436000B2

(12) United States Patent
Stalder et al.

(10) Patent No.: US 10,436,000 B2
(45) Date of Patent: Oct. 8, 2019

(54) FISHBONE WELL CONFIGURATION FOR SAGD

(71) Applicants: Total E&P Canada, Ltd., Calgary (CA); ConocoPhillips Canada Resources Corp., Calgary (CA); ConocoPhillips Surmont Partnership, Calgary (CA)

(72) Inventors: John L. Stalder, Houston, TX (US); Son V. Pham, Houston, TX (US)

(73) Assignees: ConocoPhillips Resources Corp., Calgary (CA); ConocoPhillips Surmont Partnership, Calgary (CA); Total E&P Canada Ltd., Calgary (CA)

( * ) Notice: Subject to any disclaimer, the term of this patent is extended or adjusted under 35 U.S.C. 154(b) by 293 days.

(21) Appl. No.: 14/173,267

(22) Filed: Feb. 5, 2014

(65) Prior Publication Data

US 2014/0345861 A1 Nov. 27, 2014

Related U.S. Application Data

(60) Provisional application No. 61/826,329, filed on May 22, 2013.

(51) Int. Cl.

| | |
|---|---|
| ***E21B 43/16*** | (2006.01) |
| ***E21B 43/24*** | (2006.01) |
| ***E21B 43/30*** | (2006.01) |

(52) U.S. Cl.

CPC ..... *E21B 43/16* (2013.01); *E21B 43/2406* (2013.01); *E21B 43/305* (2013.01)

(58) Field of Classification Search

CPC ..... E21B 43/16; E21B 43/2406; E21B 43/305

See application file for complete search history.

(56) References Cited

U.S. PATENT DOCUMENTS

| | | | | |
|---|---|---|---|---|
| 5,273,111 | A | 12/1993 | Brannan | |
| 7,066,254 | B2 * | 6/2006 | Vinegar et al. | 166/245 |
| 8,118,095 | B2 * | 2/2012 | Sarathi et al. | 166/260 |
| 8,307,915 | B2 * | 11/2012 | Clark et al. | 175/62 |
| 8,333,245 | B2 | 12/2012 | Zupanick | |
| 8,376,052 | B2 | 2/2013 | Zupanick | |
| 8,381,810 | B2 * | 2/2013 | Dreher et al. | 166/245 |
| 8,695,730 | B2 * | 4/2014 | Clark et al. | 175/62 |

(Continued)

FOREIGN PATENT DOCUMENTS

| | | |
|---|---|---|
| CA | 2684049 | 4/2011 |
| WO | PCT/US14/014774 | 5/2014 |

OTHER PUBLICATIONS

SPE 69700, Stalder, "Multilateral-Horizontal Wells Increase Rate and Lower Cost Per Barrel in the Zuata Field, Faja, Venezuela", Mar. 12, 2001.

(Continued)

*Primary Examiner* — William D Hutton, Jr.
*Assistant Examiner* — Crystal J Miller
(74) *Attorney, Agent, or Firm* — Boulware & Valoir

(57) ABSTRACT

The present disclosure relates to a particularly effective well configuration that can be used for SAGD and other steam based oil recovery methods. Fishbone multilateral wells are combined with SAGD, effectively expanding steam coverage. Preferably, an array of overlapping fishbone wells cover the pay, reducing water use and allowing more complete production of the pay.

21 Claims, 13 Drawing Sheets

(56) References Cited

U.S. PATENT DOCUMENTS

| | | | | |
|---|---|---|---|---|
| 8,701,770 | B2 * | 4/2014 | Schultz et al. | 166/303 |
| 9,388,676 | B2 * | 7/2016 | Jorshari | E21B 43/2406 166/245 |
| 2003/0155111 | A1 * | 8/2003 | Vinegar et al. | 166/59 |
| 2007/0044957 | A1 * | 3/2007 | Watson | E21B 33/03 166/245 |
| 2009/0255661 | A1 * | 10/2009 | Clark | E21B 41/0035 166/50 |
| 2010/0206555 | A1 | 8/2010 | Menard | |
| 2010/0206563 | A1 * | 8/2010 | Sarathi et al. | 166/256 |
| 2011/0036576 | A1 * | 2/2011 | Schultz et al. | 166/303 |
| 2011/0061937 | A1 | 3/2011 | Orban | |
| 2011/0067858 | A1 * | 3/2011 | Dreher | E21B 43/243 166/251.1 |
| 2012/0227966 | A1 | 9/2012 | Dreher | |
| 2012/0241150 | A1 * | 9/2012 | Al Yahyai et al. | 166/270 |
| 2012/0247760 | A1 * | 10/2012 | Wheeler et al. | 166/272.3 |
| 2013/0075084 | A1 * | 3/2013 | Clark et al. | 166/245 |
| 2013/0118737 | A1 * | 5/2013 | Schneider et al. | 166/272.3 |
| 2013/0146285 | A1 * | 6/2013 | Chhina et al. | 166/268 |
| 2014/0048259 | A1 * | 2/2014 | Menard | E21B 43/24 166/272.3 |
| 2014/0124194 | A1 * | 5/2014 | Jorshari | E21B 43/2406 166/245 |
| 2014/0182850 | A1 * | 7/2014 | Shahin et al. | 166/266 |
| 2014/0367097 | A1 * | 12/2014 | Milam et al. | 166/272.4 |
| 2015/0240611 | A1 * | 8/2015 | Joshari | E21B 43/2406 166/245 |

OTHER PUBLICATIONS

Stalder J.L., et al., Alternative Well Configurations in SAGD: Rearranging Wells to Improve Performance, presented at 2012 World Heavy Oil Congress [WHOC12].

OTC 16244, Lougheide, et al. Trinidad's First Multilateral Well Successfully Integrates Horizontal Openhole Gravel Packs, OTC (2004).

EME 580 Final Report: Husain, et al., Economic Comparison of Multi-Lateral Drilling over Horizontal Drilling for Marcellus Shale Field (2011).

SPE-38493-MS, Hogg, C. "Comparison of Multilateral Completion Scenarios and Their Application." Presented at the Offshore Europe, Aberdeen, United Kingdom, Sep. 9-12, 1997.

* cited by examiner

FISHBONE WELL CONFIGURATION FOR SAGD

PRIORITY CLAIM

This application claims priority to U.S. Ser. No. 61/826,329, filed May 22, 2013, and expressly incorporated by reference herein in its entirety for all purposes.

FEDERALLY SPONSORED RESEARCH STATEMENT

Not Applicable

FIELD OF THE INVENTION

This invention relates generally to well configurations that can advantageously produce oil using steam-based mobilizing techniques. In particular, interlocking fishbone wells are employed for SAGD, wherein a plurality of injectors and producers have multilateral wells that extend drainage and steam injection coverage throughout the entire region between the adjacent wells.

BACKGROUND OF THE INVENTION

Oil sands are a type of unconventional petroleum deposit. The sands contain naturally occurring mixtures of sand, clay, water, and a dense and extremely viscous form of petroleum technically referred to as "bitumen," but which may also be called heavy oil or tar. Many countries in the world have large deposits of oil sands, including the United States, Russia, and the Middle East, but the world's largest deposits occur in Canada and Venezuela.

Bitumen is a thick, sticky form of crude oil, so heavy and viscous (thick) that it will not flow unless heated or diluted with lighter hydrocarbons. At room temperature, bitumen is much like cold molasses. Often times, the viscosity can be in excess of 1,000,000 cP.

Due to their high viscosity, these heavy oils are hard to mobilize, and they generally must be made to flow in order to produce and transport them. One common way to heat bitumen is by injecting steam into the reservoir. Steam Assisted Gravity Drainage (SAGD) is the most extensively used technique for in situ recovery of bitumen resources in the McMurray Formation in the Alberta Oil Sands (Butler, 1991).

In a typical SAGD process, shown in FIG. 1, two horizontal wells are vertically spaced by 4 to 10 meters (m). The production well is located near the bottom of the pay and the steam injection well is located directly above and parallel to the production well. In SAGD, steam is injected continuously into the injection well, where it rises in the reservoir and forms a steam chamber.

With continuous steam injection, the steam chamber will continue to grow upward and laterally into the surrounding formation. At the interface between the steam chamber and cold oil, steam condenses and heat is transferred to the surrounding oil. This heated oil becomes mobile and drains, together with the condensed water from the steam, into the production well due to gravity segregation within steam chamber.

This use of gravity gives SAGD an advantage over conventional steam injection methods. SAGD employs gravity as the driving force and the heated oil remains warm and movable when flowing toward the production well. In contrast, conventional steam injection displaces oil to a cold area, where its viscosity increases and the oil mobility is again reduced.

Conventional SAGD tends to develop a cylindrical steam chamber with a somewhat tear drop or inverted triangular cross section. With several SAGD well pairs operating side by side, the steam chambers tend to coalesce near the top of the pay, leaving the lower "wedge" shaped regions midway between the steam chambers to be drained more slowly, if at all. Operators may install additional producing wells in these midway regions to accelerate recovery, as shown in FIG. 2, and such wells are called "infill" wells, filling in the area where oil would normally be stranded between SAGD well-pairs.

Although quite successful, SAGD does require enormous amounts of water in order to generate a barrel of oil. Some estimates provide that 1 barrel of oil from the Athabasca oil sands requires on average 2 to 3 barrels of water, although with recycling the total amount can be reduced to 0.5 barrel. In addition to using a precious resource, additional costs are added to convert those barrels of water to high quality steam for downhole injection. Therefore, any technology that can reduce water or steam consumption has the potential to have significant positive environmental and cost impacts.

One concept for improving production is the "multilateral" or "fishbone" well configuration idea. The concept of fishbone wells for non-thermal horizontal wells was developed by Petrozuata in Venezuela starting in 1999. That operation was a cold, viscous oil development in the Faja del Orinoco Heavy Oil Belt. The basic concept was to drill open-hole side lateral wells or "ribs" off the main spine of a producing well prior to running slotted liner into the spine of the well (FIG. 3). Such ribs appeared to significantly contribute to the productivity of the wells when compared to wells without the ribs in similar geology (FIG. 4). A variety of multilateral well configurations are possible, see FIG. 5, although many have not yet been tested.

The advantages of multilateral wells can include:

1) Higher Production. In the cases where thin pools are targeted, vertical wells yield small contact with the reservoir, which causes lower production. Drilling several laterals in thin reservoirs and increasing contact improves recovery. Slanted laterals can be of particular benefit in thin stacked pay zones.

2) Decreased Water/Gas Coning. By increasing the length of "wellbore" in a horizontal strata, the inflow flux around the wellbore can be reduced. This allows a higher withdrawal rate with less pressure gradient around the producer. Coning is aggravated by pressure gradients that exceed the gravity forces that stabilize fluid contacts (oil/water or gas/water), so that coning is minimized with the use of multilaterals which minimize the pressure gradient.

3) Improved sweep efficiency. By using multilateral wells, the sweep efficiency may be improved, and/or the recovery may be increased due to the additional area covered by the laterals.

4) Faster Recovery. Production from the multilateral wells is at a higher rate than that in single vertical or horizontal wells, because the reservoir contact is higher in multilateral wells.

5) Decreased environmental impact. The volume of consumed drilling fluids and the generated cuttings during drilling multilateral wells are less than the consumed drilling fluid and generated cuttings from separated wells, at least to the extent that two conventional horizontal wells are replaced by one dual lateral well and to the extent that laterals share the same mother-bore. Therefore, the impact of the multilateral wells on the environment can be reduced.

6) Saving time and cost. Drilling several laterals in a single well may result in time and cost saving in comparison with drilling several separate wells in the reservoir.

Multilateral wells have been described for a variety of patented methods. EP2193251 discloses a method of drilling multiple short laterals that are of smaller diameter. These multiple short laterals can be drilled at the same depth from the same main wellbore, so as to perform treatments in and from the small laterals to adapt or correct the performance of the main well, the formation properties, the formation fluids and the change of porosity and permeability of the formation. However, the short laterals do not address the issue where the prism between two adjacent SAGD well pairs is hard to produce/deplete.

US20110036576 discloses a method of injecting a treatment fluid through a lateral injection well such that the hydrocarbon can be treated by the treatment fluid before production. However, the addition of treatment fluid is known in the field and this well configuration does not increase the contact with the hydrocarbon reservoir.

CA2684049 describes the use of infill wells (between pairs of SAGD well-pairs) that are equipped with multilateral wells, so as to allow the targeting of additional regions. However, no general applicability to SAGD was described in this application.

Although an improvement, the multilateral well methods have disadvantages too. One disadvantage is that fishbone wells are more complex to drill and clean up. Indeed, some estimate that multilaterals cost about 20% more to drill and complete than conventional slotted liner wells. Another disadvantage is increased risk of accident or damage, due to the complexity of the operations and tools. Sand control can also be difficult. In drilling multilateral wells, the mother well bore can be cased to control sand production, however, the legs branched from the mother well bore are open hole. Therefore, the sand control from the branches is not easy to perform. There is also increased difficulty in modeling and prediction due to the sophisticated architecture of multilateral wells.

Another area of uncertainty with the fishbone concept is whether the ribs will establish and maintain communication with the offset steam chambers, or will the open-hole ribs collapse early and block flow. One of the characteristics of the Athabasca Oil Sands is that they are unconsolidated sands that are bound by the million-plus centipoises bitumen. When heated to 50-80° C. the bitumen becomes slightly mobile. At this point the open hole rib could collapse. If so, flow would slow to a trickle, temperature would drop, and the rib would be plugged. However, if the conduit remains open at least long enough that the bitumen in the near vicinity is swept away with the warm steam condensate before the sand grains collapse, then it may be possible that a very high permeability, high water saturation channel might remain even with the collapse of the rib. In this case, the desired conduit would still remain effective.

Another uncertainty with many ribs along a fishbone producer of this type is that one rib may tend to develop preferentially at the expense of all the other ribs leading to very poor conformance and poor results. This would imply that some form of inflow control may be warranted to encourage more uniform development of all the ribs.

Therefore, although beneficial, the multilateral well concept could be further developed to address some of these disadvantages or uncertainties. In particular, a method that combines multilateral well architecture with steam assisted processes would be beneficial, especially if such methods conserved the water, energy, and/or cost to produce a barrel of oil.

SUMMARY OF THE DISCLOSURE

Current SAGD practice involves arranging horizontal production wells low in the reservoir pay interval and horizontal steam injection wells approximately 4-10 meters above and parallel to the producing wells. Well pairs may be spaced between 50 and 150 meters laterally from one another in parallel sets to extend drainage across reservoir areas developed from a single surface drilling pad.

Typically such wells are preheated by circulating steam from the surface down a toe tubing string that ends near the toe of the horizontal liner; steam condensate returns through the tubing-liner annulus to a heel tubing string that ends near the liner hanger and flows back to the surface through this heel tubing string. After such circulation in both the producer and the injector wells for a period of about 3 months, the reservoir midway between the injector and producer wells will reach a temperature high enough (50-100° C.) so that the bitumen becomes mobile and can drain by gravity downward, while live steam vapor ascends by the same gravity forces to establish a steam chamber. At this time, the well pair is placed into SAGD operation with injection in the upper well and production from the lower well.

The fishbone well concept for non-thermal primary production has been described in prior art such as SPE 69700 and the concept of fishbone infill producers between conventional SAGD well-pairs is the subject of Suncor patent CA2684049. However, the idea of using multilateral wells has not been generally applied as described and claimed herein.

The disclosure relates to well configurations that are used to improve steam recovery of oil, especially heavy oils. In general, fishbone wells replace conventional wellbores in SAGD operations. Either or both injector and producer wells are multilateral, and preferably the arrangement of lateral wells, herein called "ribs" is such as to provide overlapping coverage of the pay zone between the injector and producer wells.

Where both well types have laterals, a pair of ribs can cover or nearly cover the distance between two wells, but where only one of the well types is outfitted with laterals, the lateral length can be doubled such that the single rib covers most of the distance between adjacent wells. It is also possible for laterals to intersect with each other or with one of the main wellbores.

The density and lengths of open-hole ribs may be varied to suit the particular environment, but, as noted, preferably to nearly reach, reach and/or extend beyond an opposing rib originating from an adjacent wellbore or an adjacent wellbore. Also the spacing between injectors and producers, both vertically and laterally, in the pay section may be optimized for the particular reservoir conditions. The open-hole ribs may be horizontal, slanted, or curved in the vertical dimension to optimize performance. Where pay is thin, horizontal laterals may suffice, but if the pay is thick and/or there are many stacked thin pay zones, it may be beneficial to combine horizontal and slanted laterals, thus contacting more of the pay zone.

With sufficient lateral well coverage, it may be possible to significantly reduce or even completely eliminate conventional steam circulation for preheating that is required for conventional SAGD, especially where lateral well coverage reaches from the production wells to the injector wells, thus establishing immediate or nearly immediate fluid communication.

Flow distribution control may be used in either or both the injectors and producers to further optimize performance along all the ribs instead of the ones closer to the heel, and to potentially lower the development cost. Because it is known in the art, the flow distribution control will not be discussed in detail herein. However, different flow distribution control mechanisms may be employed in the present invention for better thermal efficiency and/or production of SAGD. For example, flow distribution control built into the liner could eliminate the toe tubing and achieve the target flow capacity with a smaller liner and reduce the amount of steel placed in the ground. The cost saving of smaller liners and casing, and the elimination of the toe tubing string could offset the added cost of flow distribution control without considering the upside of better performance from the wells.

One method commonly used to improve flow distribution within a horizontal well is to use several throttling devices distributed along the horizontal completion, such as using orifices to impose a relatively high pressure drop at exit or entry points compared to the pressure drop for flow inside the base pipe. In this case, the toe tubing string can be eliminated from the base pipe, with the caveat that limited remediation is available if needed. If, alternatively, the flow distribution control devices are installed on a toe tubing string, which could be removed for servicing when needed, it is less likely to be possible to reduce the size of liner.

Such wells can be placed as infill wells or well pairs between conventional SAGD well pairs or used entirely independently of conventional SAGD well pairs.

With the fishbone SAGD methodology described herein, the injection wells may or may not be placed directly vertically above the producing well. In particular, a preferred embodiment may be to place the injectors and producers laterally apart by 50 to 150 meters, using the lateral wells to bridge the steam gaps. Combinations of lateral and vertical spacing may also be used.

Flow distribution control may be used in either or both the injector and producer wells to effect better fluid flow patterns throughout the process. Once the heated fluids flow from the injection wells through the open-hole ribs to the producing wells' open-hole ribs and into the liners of the producing wells, a preheating effect will occur. This will occur without the average 3 months steam circulation that is in current use, which simplifies well operation, and reduces costs. Over time the heated regions will expand due to heat transfer and bitumen will become mobilized and SAGD chamber(s) will develop as in conventional SAGD.

Conventional SAGD typically is slow to deplete a triangular prism (referred to as "wedge" in certain literature, see e.g., FIG. 2) midway between well pairs. The fishbone SAGD concept proposed herein eliminates this wedge and accelerates recovery between the liners of the adjacent wells. It may be possible to increase lateral spacing between wells and still achieve more rapid production of the resource, while using less steam/water overall.

Furthermore, well-pairs can be replaced by single wells in this concept so that the number of wells may be cut in half or further. The key to the idea is the spacing and length of the ribs attached to each of the wells. Petrozuata experience (Venezuela) indicated that fishbone wells cost about 20% more to drill and complete than conventional slotted liner wells. However, in SAGD, if fishbone wells reduce well count to half or less, there is a clear overall cost savings, as well as the performance benefits mentioned herein.

The herein described well configurations have the potential to nearly eliminate preheat circulation, thus eliminating toe tubing strings, which allows smaller liners, casings, and drilled hole sizes for lower well cost. It also can eliminate dual wellhead plumbing, manifolding, and dual control valves for each well. As such, it simplifies well intervention by having a single tubing string. It also reduces total well count and more quickly develops "wedge" oil that is often stranded between conventional vertically spaced SAGD well-pairs.

All of oil sands SAGD development could profit by reduced cost (fewer wells, smaller liners, casing, drilling cost and surface facility cost) as well as from accelerated SAGD startup (now 90+ days, but reduced and simplified to much less in the present invention) and higher efficiency by eliminating the countercurrent heat exchange losses that result from circulating steam down the toe tubing string and returning the steam condensate through the tubing-liner annulus and back to the surface in the same wellbore containing the toe tubing string.

The invention can comprise any one or more of the following embodiments, in any combination:

- A well configuration for steam assisted gravity drainage (SAGD) production of hydrocarbons, the well configuration comprising: a) a plurality of horizontal production wells at a first depth at or near the bottom of a hydrocarbon play; b) a plurality of horizontal injection wells, each injection well laterally spaced at a distance D from an adjacent production well; c) a plurality of lateral wells originating from said plurality of horizontal production wells or said plurality of horizontal injection wells or both, wherein said plurality of lateral wells cover at least 80%, 90%, 95%, 98%, 100% or more of said distance D.
- A well configuration for steam production of hydrocarbons, the well configuration comprising: a) a plurality of horizontal production wells; b) a plurality of horizontal injection wells laterally spaced apart from a production well at a first distance D; c) a plurality of lateral wells originating from said plurality of horizontal production wells or said plurality of horizontal injection wells or both, such that said lateral wells extend over at least 80% of said first distance D between adjacent wells.
- A well configuration wherein said a plurality of lateral wells originate from each of said plurality of horizontal production wells and horizontal injection wells, and cover at least 98% of said distance D.
- A well configuration wherein said a plurality of lateral wells originate from each of said plurality of horizontal production wells, and intersect with an adjacent injector well or a lateral extending from an adjacent injector well.
- A well configuration wherein said a plurality of lateral wells originate from each of said plurality of horizontal production wells and slant upwards towards an adjacent injection well.
- A well configuration wherein said plurality of lateral wells are arranged in an alternating pattern.
- A well configuration wherein said a plurality of lateral wells originate from each of said plurality of horizontal production wells and said plurality of horizontal injection wells and are arranged in an alternating pattern such that ends of lateral wells from adjacent wells overlap, such that together a pair of lateral wells cover at least 100% of said distance D.

A well configuration wherein each injection well is about at said first depth.

A well configuration wherein each injection well is at a lesser depth than said first depth.

A well configuration wherein said distance D is at least 50 meters, 100 meters or 150 meters.

A well configuration wherein said lateral wells extend over at least 90%, 95%, 98%, 100% or more of said first distance D between adjacent wells.

An improved method of SAGD, SAGD comprising a lower horizontal production well, a higher injection well, wherein steam is injected into said injection well to mobilize oil which then gravity drains to said production well, the improvement comprising: a) providing a plurality of horizontal production wells and a plurality of horizontal injection wells, b) each injector well spaced laterally apart from an adjacent production well, c) said plurality of horizontal production wells each having a plurality of lateral wells extending towards a nearest horizontal injection well, or said plurality of horizontal injector wells each having a plurality of lateral wells extending towards a nearest horizontal production well, or both.

An improved method of SAGD, SAGD comprising a lower horizontal production well, a higher injection well, wherein steam is injected into said injection well to mobilize oil which then gravity drains to said production well, the improvement comprising providing an array of alternating horizontal production wells and horizontal injection wells laterally spaced apart and each having a plurality of lateral wells extending over the distance between adjacent wells.

An improved method of SAGD, SAGD comprising a lower horizontal production well, a higher injection well, wherein in a preheat step a) steam is injected into each of said wells until fluid communication is established between wells, wherein after the preheat step steam is injected into said injection well to mobilize oil which then gravity drains to said production well for production, the improvement comprising: a) providing an array of alternating lower horizontal production wells and higher horizontal injection wells, b) each adjacent well spaced laterally apart, c) said lower horizontal production wells each also having a plurality of lateral wells extending upwards towards an adjacent higher horizontal injection well, and d) wherein said preheat step is greatly reduced or eliminated.

An improved method of SAGD oil production, wherein SAGD comprises a horizontal production well and an injection well, said wells spaced vertically apart, wherein in a preheat step a) steam is injected into each of said wells until fluid communication is established between said wells, and b) steam is injected into said injection well to mobilize oil, and c) heated oil is gravity driven to said production well for production, the improvement comprising providing alternating production wells and injection wells spaced laterally apart, some of said wells each also having a plurality of lateral wells extending towards a nearest neighbor well, and wherein the preheat step a) is reduced by at least 80%, 90%, 95%, 98% or eliminated.

A method of steam or SAGD production of hydrocarbons, said method comprising a) providing a well configuration as described herein; b) injecting steam into each of said plurality of horizontal injection wells; c) heating hydrocarbons to produce mobilized hydrocarbons; and d) producing said mobilized hydrocarbons from said production wells.

"Vertical" drilling is the traditional type of drilling in oil and gas drilling industry, and includes well<45° of vertical.

"Horizontal" drilling is the same as vertical drilling until the "kickoff point" which is located just above the target oil or gas reservoir (pay zone), from that point deviating the drilling direction from the vertical to horizontal. By "horizontal" what is included is an angle within 45° (≤45°) of horizontal.

"Multilateral" wells are wells having multiple branches (laterals) tied back to a mother wellbore (also called the "originating" well), which conveys fluids to or from the surface. The branch or lateral may be vertical or horizontal, or anything therebetween.

A "lateral" well as used herein refers to a well that branches off an originating well. An originating well may have several such lateral wells (together referred to as multilateral wells), and the lateral wells themselves may also have lateral wells.

An "alternate pattern" or "alternating pattern" as used herein means that subsequent lateral wells alternate in direction from the originating well, first projecting to one side, then to the other.

As used herein a "slanted" well with respect to lateral wells, means that the well is not in the same plane as the originating well, but travels upwards or downwards from same.

As used herein, "overlapping" multilateral wells, means the ends of lateral wells from adjacent wellbores nearly reach or even pass each other or the next adjacent main wellbore, when viewed from the top as shown in the FIGS. 6-12.

Such lateral wells may also "intersect" if direct fluid communication is achieved by direct intersection of two lateral wells, but intersection is not necessarily implied in the terms "overlapping" wells. Where intersecting wells are specifically intended, the specification and claims will so specify.

Overlapping lateral wells is one option, but it may be more cost effective to provide e.g., only producers with lateral wells. In such cases, the laterals can be made longer so as to reach or nearly reach or even intersect with an adjacent injector. In this way, fewer laterals are needed, but the reservoir between adjacent main wellbores is still adequately covered to enable efficient steam communication and good drainage.

By "nearly reach" we mean at least 95% of the distance between adjacent main wellbores is covered by a lateral or a pair of laterals.

By "main wellbores" what is meant are injector and producer wells. Producer wells can also be used for injection early in the process.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

The following abbreviations are used herein:

| | |
|---|---|
| SAGD | Steam Assisted Gravity Drainage |
| CHOPS | Cold Heavy Oil Production with Sand |

DESCRIPTION OF EMBODIMENTS OF THE INVENTION

The present invention provides a novel well configuration for SAGD oil production, which we refer herein as a "fishbone" SAGD configuration, wherein injectors or producers or both are fitted with a plurality of multilateral wells.

Although particularly beneficial in gravity drainage techniques, this is not essential and the configuration could be used for horizontal sweeps as well. The well configuration can be used in any enhanced oil recovery techniques, including cyclic steam stimulations, SAGD, expanding solvent SAGD, polymer sweeps, water sweeps, and the like.

The ribs can be placed in any arrangement known in the art, depending on reservoir characteristics and the positioning of nonporous rocks and the play. Ribs can originate from producers or injectors or both, but may preferably originate from the producers.

Having the ribs originated from the injectors may have negative effects (such as undesired blockage or even plugging of the open-hole rib) that requires additional remedial steps, hence additional production time and cost. If the ribs originate from the producers, on the other hand, better thermal efficiency and well stability may be achieved and therefore such may be a better configuration.

In addition, the open-hole rib originated from producers may reap the benefit of steam condensate gradually warming the bitumen, and the high water-cut fluid allows the effective transport of any mobilized bitumen to be drained by gravity to the producer through an open-hole pathway rather than forcing the emulsion to flow through cold matrix as in the injector rib case.

The ribs can be planar or slanted or both, e.g., preferably slanting upwards towards the injectors, where injectors are placed higher in the pay. However, injectors need not be higher in the pay with this method. Nonetheless, upwardly slanted wells may be desirable to contact more of a thick pay, or where thin stacked pay zones exist. Downwardly slanting wells may also be used in some cases. Combinations of planar and slanted wells are also possible.

The rib arrangement on a particular main well can be pinnate, alternate, radial, or combinations thereof. The ribs can also have further ribs, if desired.

DETAIL DESCRIPTION

The following is a detailed description of the preferred method of the present invention. It should be understood that the inventive features and concepts may be manifested in other arrangements and that the scope of the invention is not limited to the embodiments described or illustrated. The scope of the invention is intended to only be limited by the scope of the claims that follow.

Figure 1:
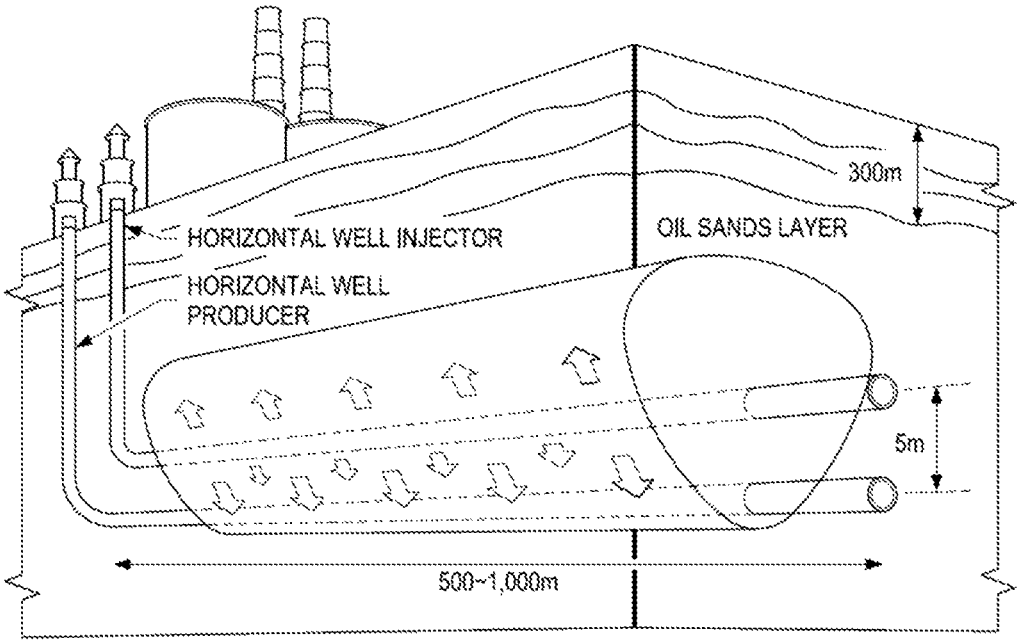
FIG. 1 (PRIOR ART)
FIG. 1 shows a conventional SAGD well pair.
Figure 2:
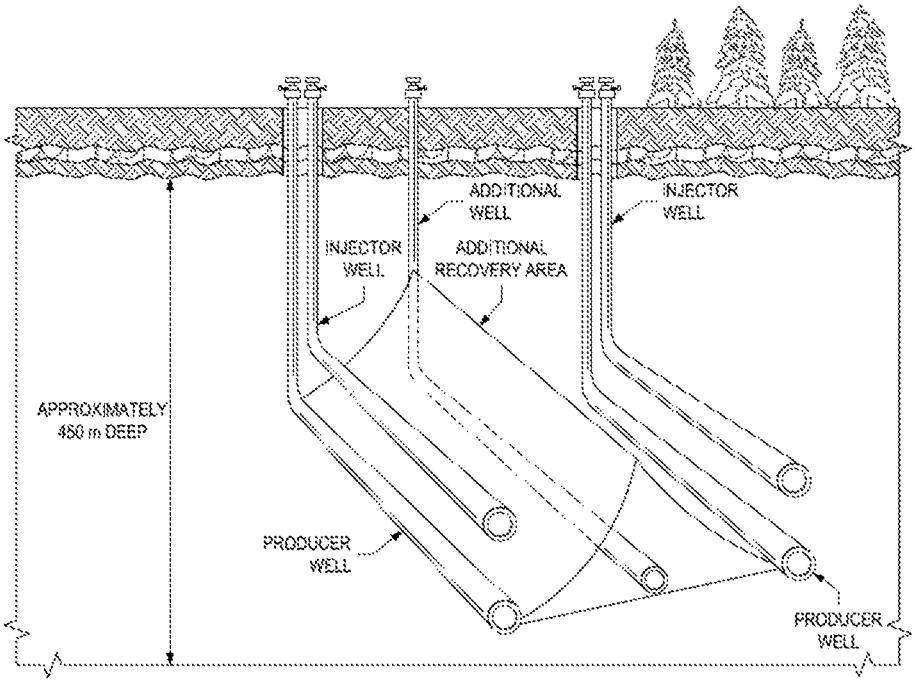
FIG. 2 (PRIOR ART)
FIG. 2 shows the addition of an additional production well between a pair of SAGD well pairs to try to capture the "wedge" of oil between pairs of well pairs that is typically left unrecovered.
Figure 3:
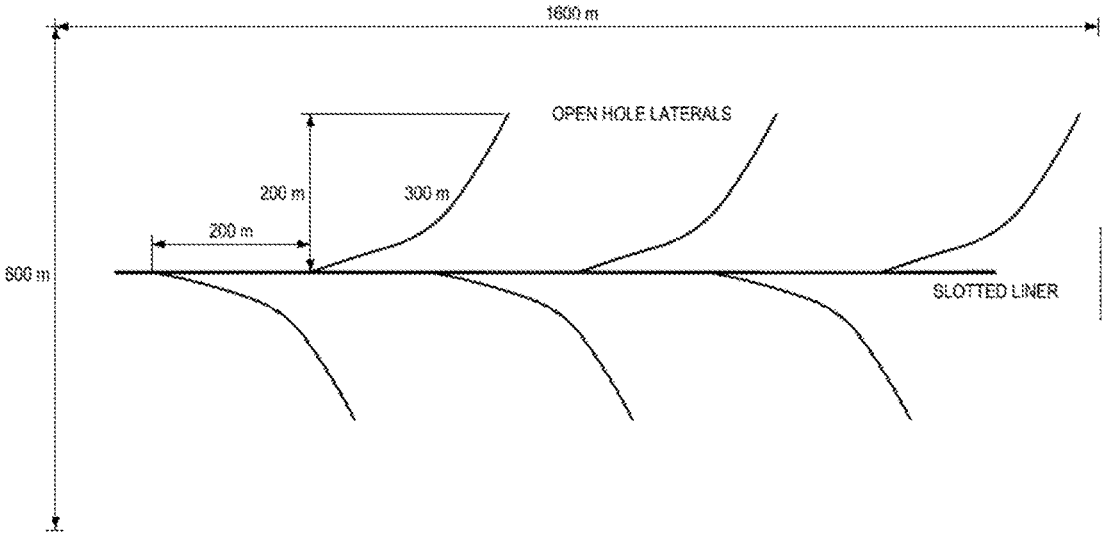
FIG. 3 (PRIOR ART)
FIG. 3 displays the original "fishbone" well configuration concept with a 1200 m horizontal slotted liner (black) with associated open hole "ribs" (red) draining a 600×1600 m region. This was a cold production method.
Figure 4:
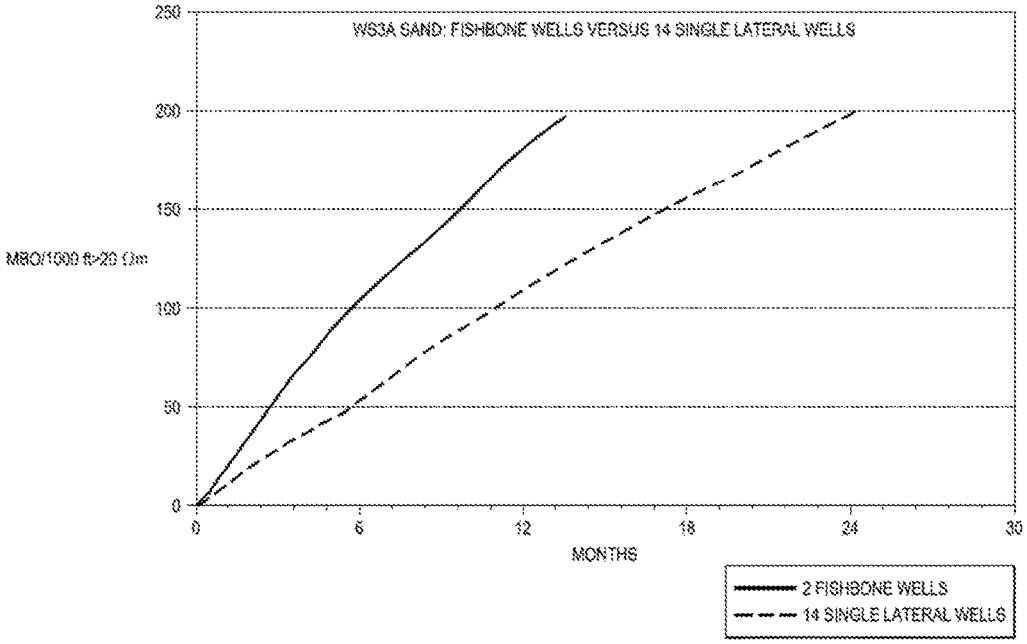
FIG. 4 (PRIOR ART)
FIG. 4 shows the cold fishbone wells' higher rate per 1000 feet of net pay measured along the spine, and demonstrates that ribs boost productivity over single laterals.
Figure 5:
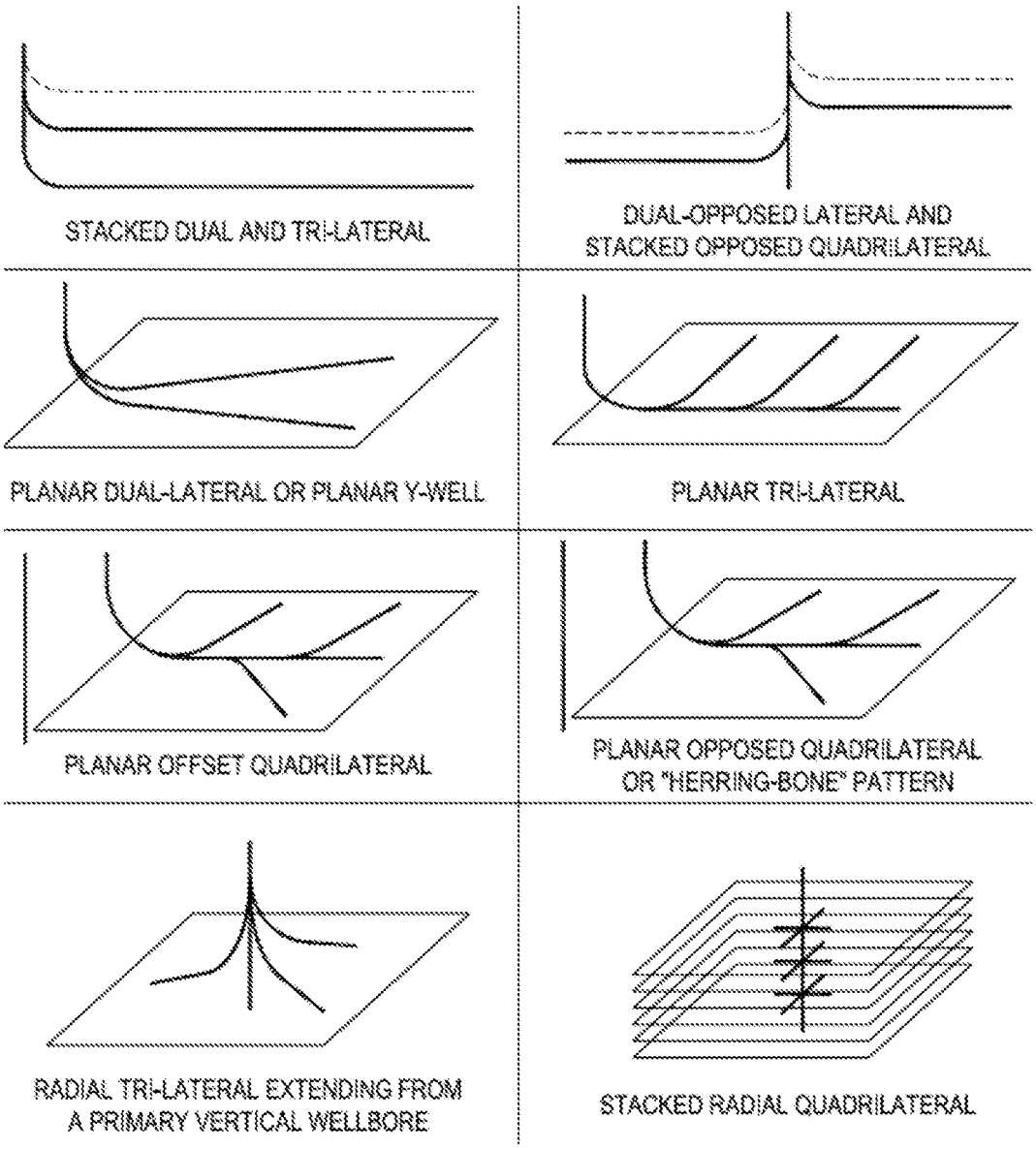
FIG. 5 (PRIOR ART)
FIG. 5 shows a variety of multilateral well configurations, but additional variations are also possible.

Some modeling studies have already been done testing the fishbone concept, and the general comparison between fishbone SAGD and classical SAGD from this work shows that fishbones accelerate recovery rates (see FIG. 4).

Sand production occurs with heavy oil production in unconsolidated sand formations. If sand production is stopped with screens or filters, this often results in near total loss of production from the well. With the use of progressive cavity pumps, sand production can be encouraged, resulting in sand cuts that can be as high as 30-40% initially before dropping to about 5%. The production of sand results in open holes, also called wormholes, that stretch into the formation away from the well.

The productivity of the well rises from the average 4 to 5 $m^3/d$ to as high as 15 to 20 $m^3/d$ as the wormholes form high permeability conduits for flow of oil and more sand. This production process is called Cold Heavy Oil Production with Sand (CHOPS). For steam circulation to be efficient, wormholes grow from low pressure tip of the wormhole toward the higher pressure source, either native reservoir or injection point or influx source such as an aquifer. In other words, the matrix material in the pay zone has to be moved or transported to allow the wormhole to grow.

With a rib drilled from the injector, where the pressure is high, it is expected that the sand at the tip of the rib cannot move because it jams against undisturbed matrix material around it. On the other hand, heated oil near the root of the rib at the injection liner will soften and allow sand in the region to become "un-cemented" and mobile. Such mobilized sand will move through the rib until it is blocked by the matrix and then "screen out" and start plugging back the tip of the rib and continue plugging back toward the root of the rib near the injection well liner. Eventually the ribs will be completely shut.

Ribs drilled from producers, on the other hand, will have considerable "accommodation space" for sand that moves from the tip of the rib back toward the production well liner where the sand will either settle along the open hole ribs or screen out against the producer liner sand exclusion media. Assuming that the distance from the tip of the producer rib to the nearest neighboring injection liner is 10 meters, because of wormhole growth tending to follow the sharpest pressure gradient, this is the likely path for wormhole to extend the producer rib tip toward the injector.

As an example, assuming the open hole rib length from the producer liner to the rib tip is on the order of 150 meters due to the build radius and the directional drilling method, the 10 meters of matrix between the rib tip and the injector will easily be accommodated by the 150 meters of open hole from the rib tip to the producer liner, so that a wormhole can easily grow to connect the producer rib tip with the injector. Based on CHOPS observations, this can happen before significant heating takes place, and we can establish a high water saturation fluid flow connection as early as steam is injected and steam condensate flows through the drilling mud filled ribs toward the producer. With progressing injection the wormholes may connect, flow capacity may increase, and hot fluids can flow, thereby allowing the elimination of preheat circulation in SAGD operations.

In use, steam can be injected into all wells for a brief period to establish fluid communication. Alternatively, steam can be injected only into injectors, since the preheat period may be effectively eliminated. Once the oil is mobilized and drains to the producers, it can then be produced.

Figure 6:
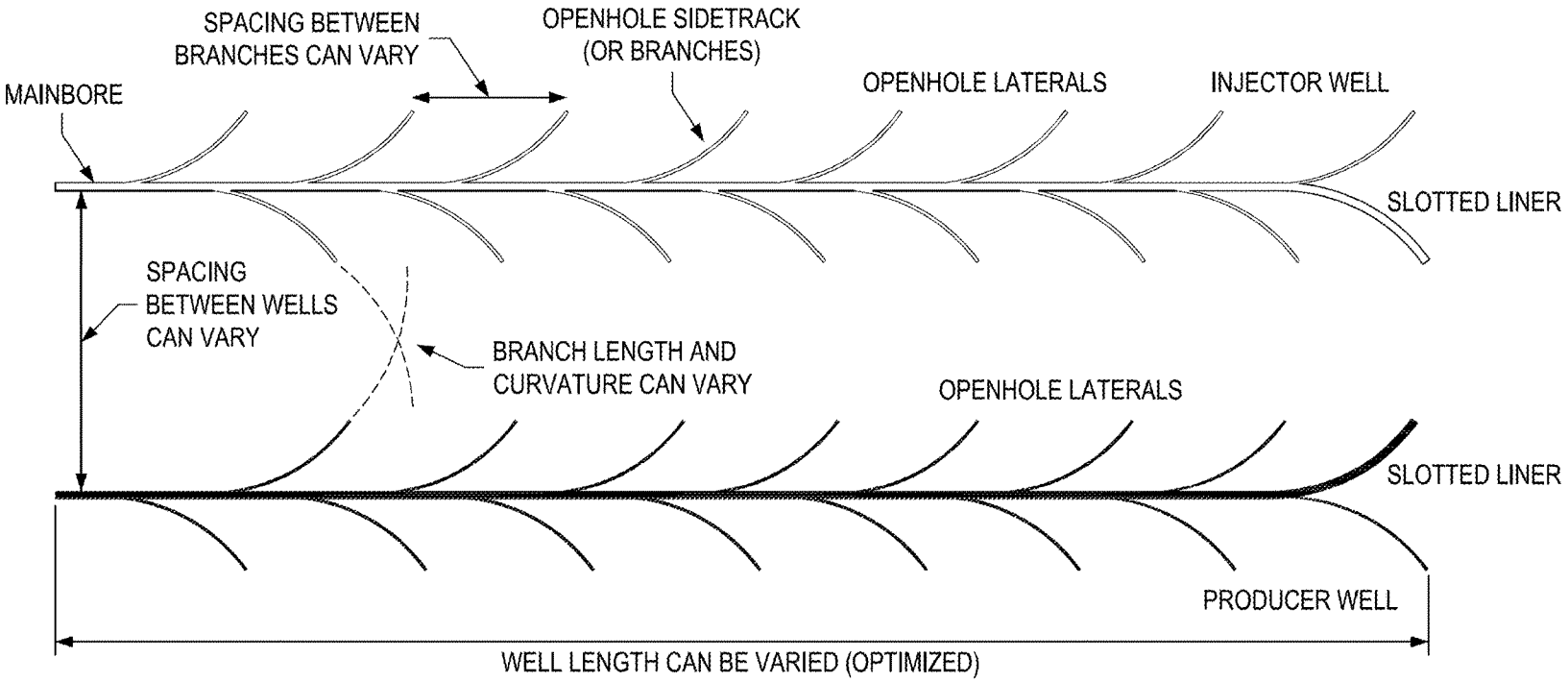
FIG. 6 is a top view schematic of the "fishbone" well configuration applied to traditional SAGD well-pairs. In this and the following figures the producer wells are black, while injectors are white, and wells equipped with slotted liners are shown as thicker than open hole wells.

FIG. 6 is a top view of one of several embodiments of this well configuration, which shows that a fishbone injector well spaced away from the producer well. In this embodiment, the spacing between the injector well and the producer well can be varied, depending partly on the expected length of the lateral wells. The spacing between each lateral well (branches) originated from either the injector well or the producer well can vary, depending on the actual geology and other considerations in actual practice. Additionally, the length and curvature of each lateral well can also vary, and in one preferred embodiment the lateral wells originated from the injector well overlap with the lateral wells originated from the producer well, such that quick fluid communication can be established.

However, overlapping laterals are not strictly required to establish the fluid communication, and instead wormholes can grow from the tip of the branches from the producer well to the injector well. In another preferred embodiment, only the producers are outfitted with multilateral wells, which nearly reach to or reach the adjacent well. Therefore, in some embodiments, the coverage may be less than 95% of the distance between main wellbores, and the ability to generate wormholes can compensate for this lack.

Figure 7A:
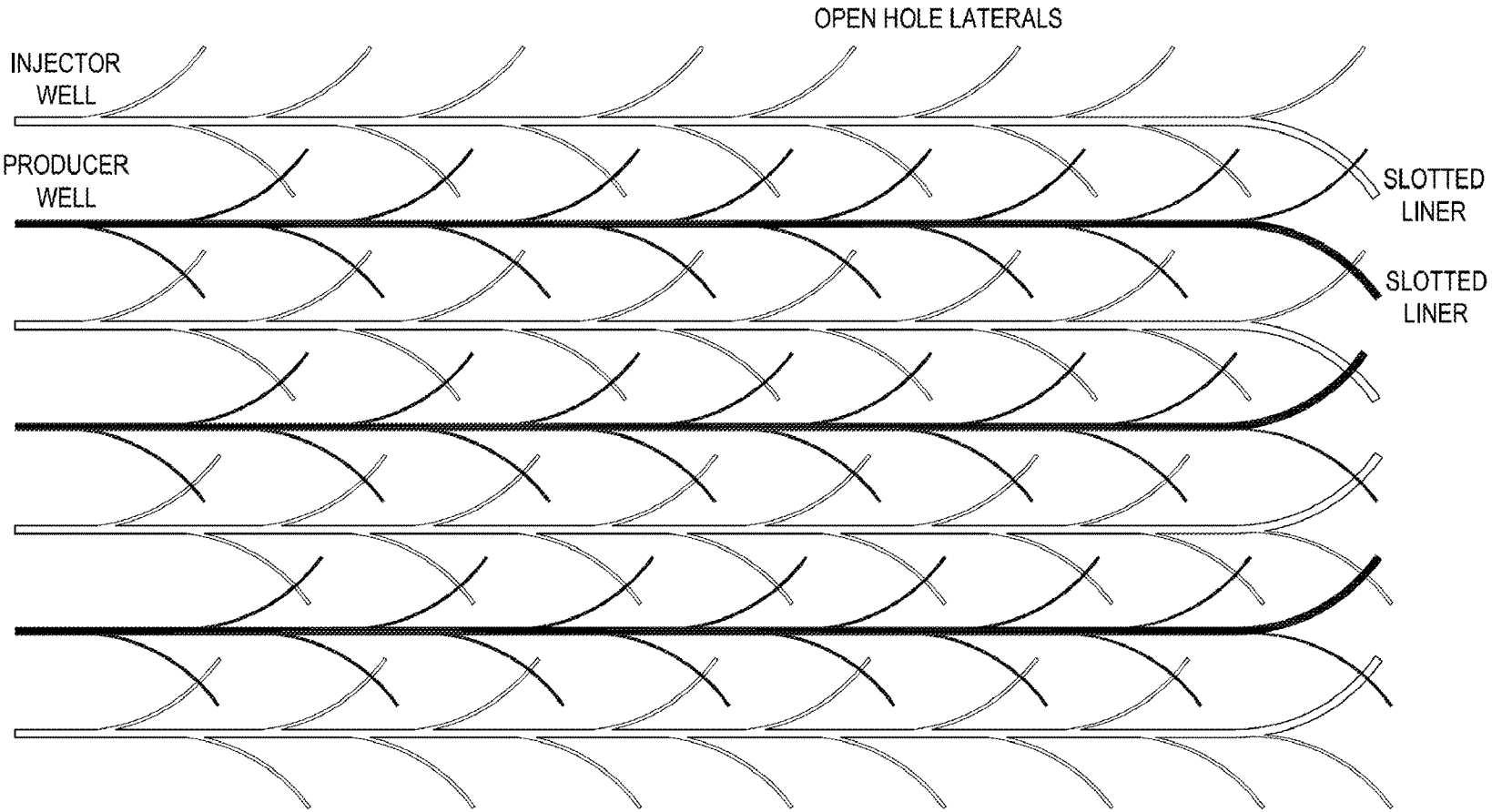
FIG. 7A-B, FIG. 8A-B, FIG. 9A-B and FIGS. 10-12 shows a variety of overlapping fishbone SAGD well configurations from a top view.
Figure 7B:
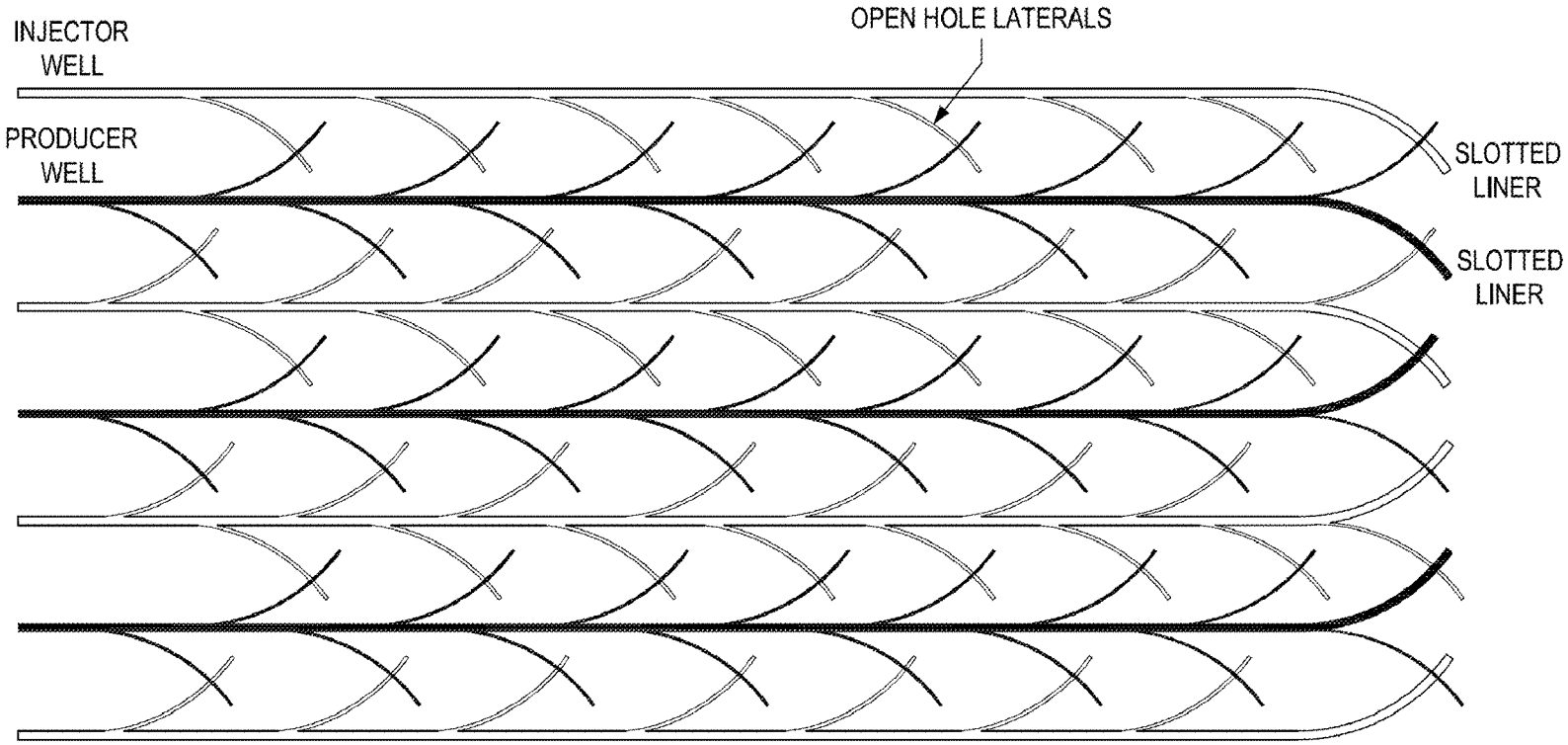

FIGS. 7A-B are variations of the embodiment as shown in FIG. 6. In these figures, the thick red lines represent the injector wells, while the thin red lines represent the lateral wells (open hole ribs) originated from the injector wells; the thick blue lines represent the producer wells, while the thin blue lines represent the lateral wells originated from the producer wells. As noted above, the spacing between each injector well and the nearest producer well can be varied to achieve better development and to produce from the "wedges" that would previously require additional infill wells to produce. The ends of the injector/producer wells can also deviate such that they can overlap with each other if necessary.

The difference between FIGS. 7A and B is that in FIG. 7A the two outermost injector wells have lateral wells extending both outwardly (away from the middle) and inwardly (toward the middle), whereas in FIG. 7B the two outermost injectors wells only have inwardly-extending lateral wells.

Figure 8A:
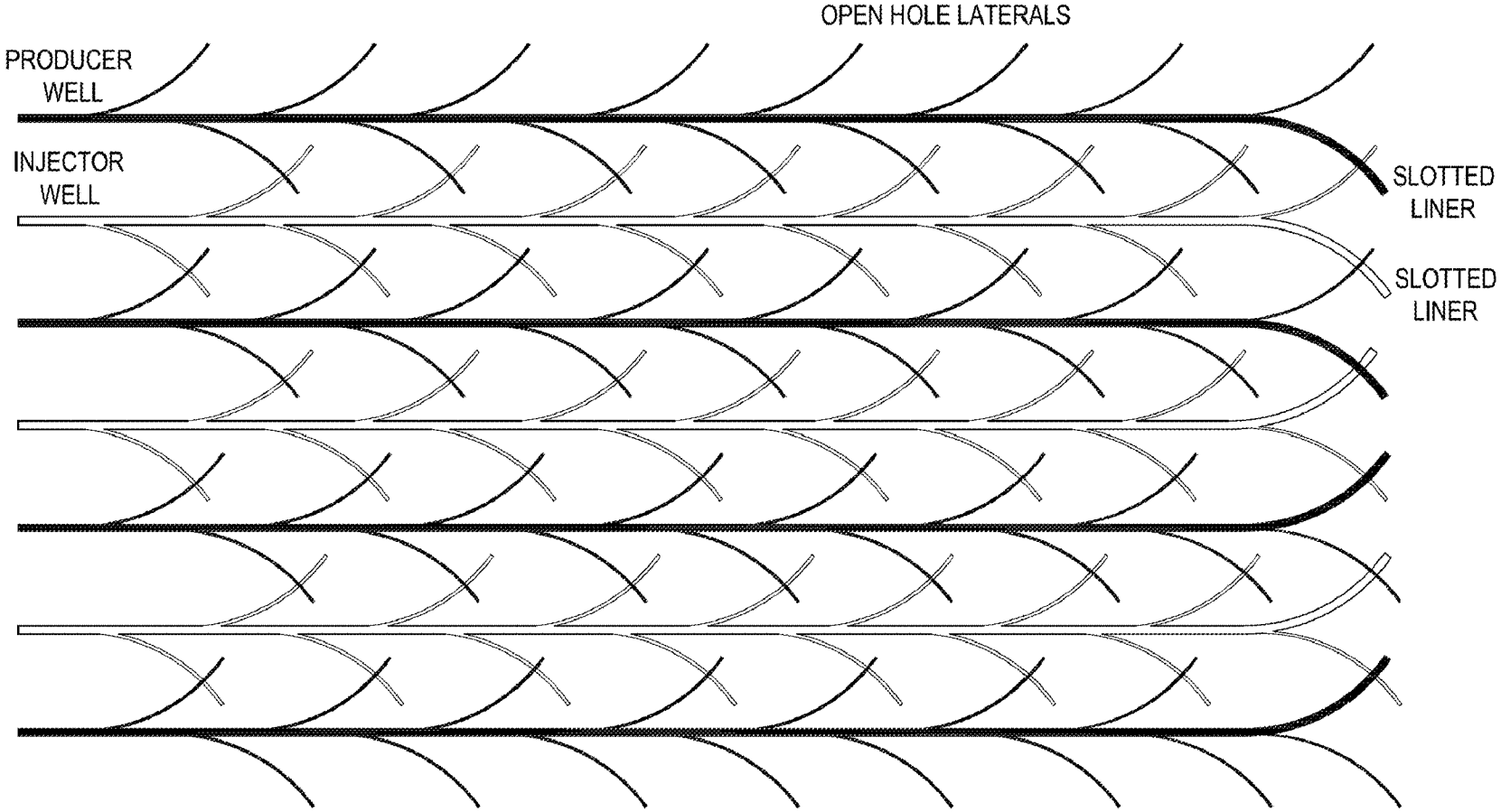
Figure 8B:
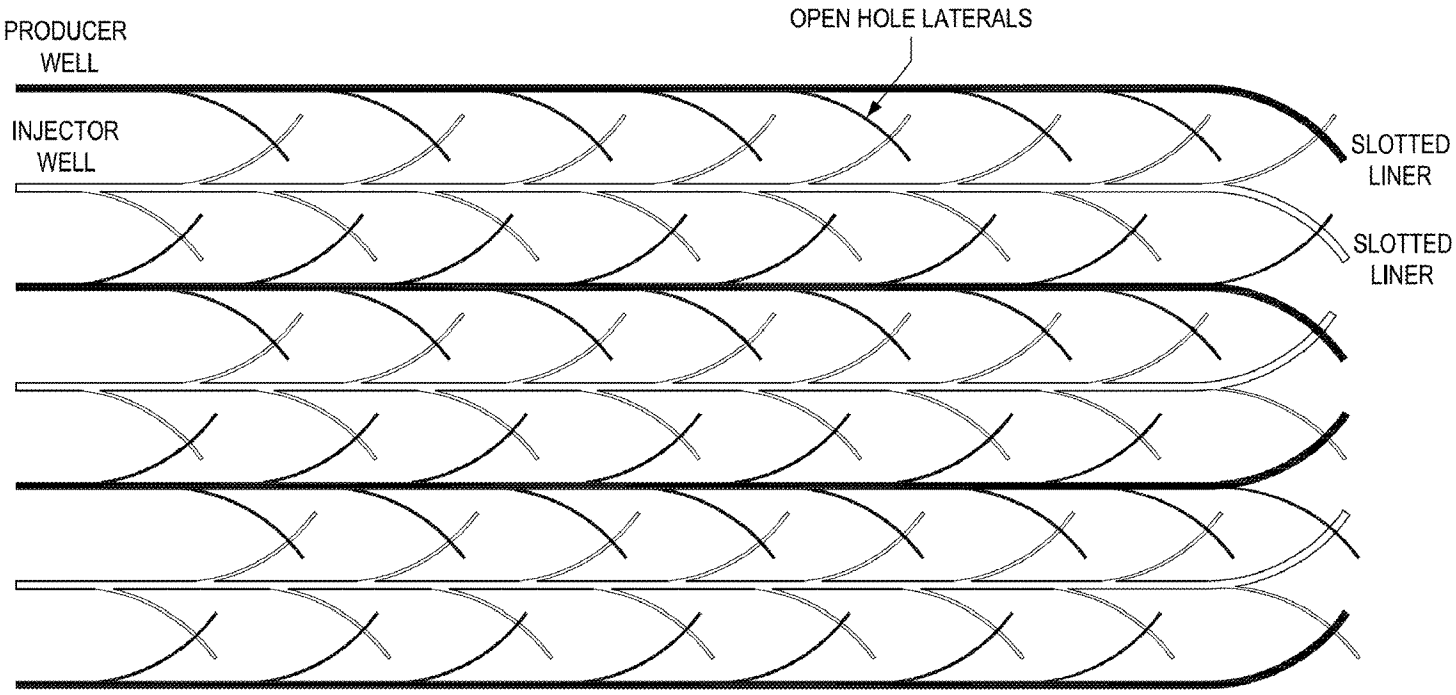

FIGS. 8A-B show another variation of the embodiment shown in FIG. 6. In this variation the two outermost wells are producer wells instead of injector wells as shown in FIGS. 7A-B. Again, in FIG. 8A the two outermost producer wells have lateral wells extending both outwardly (away from the middle) and inwardly (toward the middle), whereas in FIG. 8B the two outermost producer wells only have inwardly-extending lateral wells. In the 8A configuration the producer wells may be in a better position to more completely produce the pay zone because of the nature of SAGD operation such that the outermost producer wells provide more room for gravity drainage.

Figure 9A:
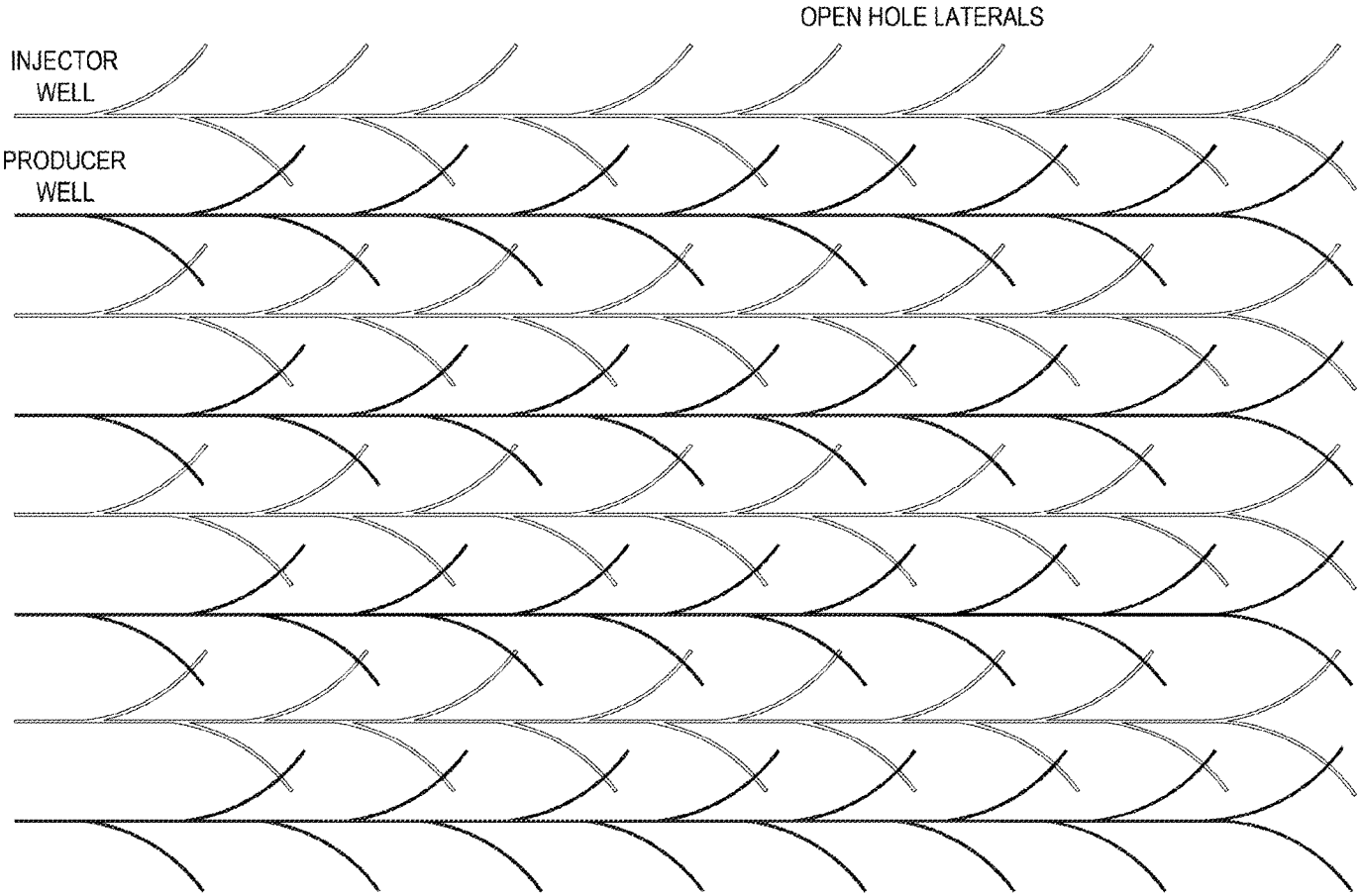

FIG. 9A provides yet another variation of the embodiment in FIG. 6. In this variation, all the horizontal wells and lateral ribs are open holes (thin lines indicate an open hole). This further reduces the need for casings and toe tubing strings in the lateral wells. Also, FIG. 9A shows that one of the outermost lateral wells at the top of the figure is an injector well, while the other one of the outermost lateral wells at the bottom of the figure is a producer well. This configuration is preferred when two drill pads are closely aligned next to each other so that the outermost producer well can benefit from the injector wells from both drill pads to produce, and the outermost injector well also provides steam/heat to mobilize bitumen for both drill pads.

Figure 9B:
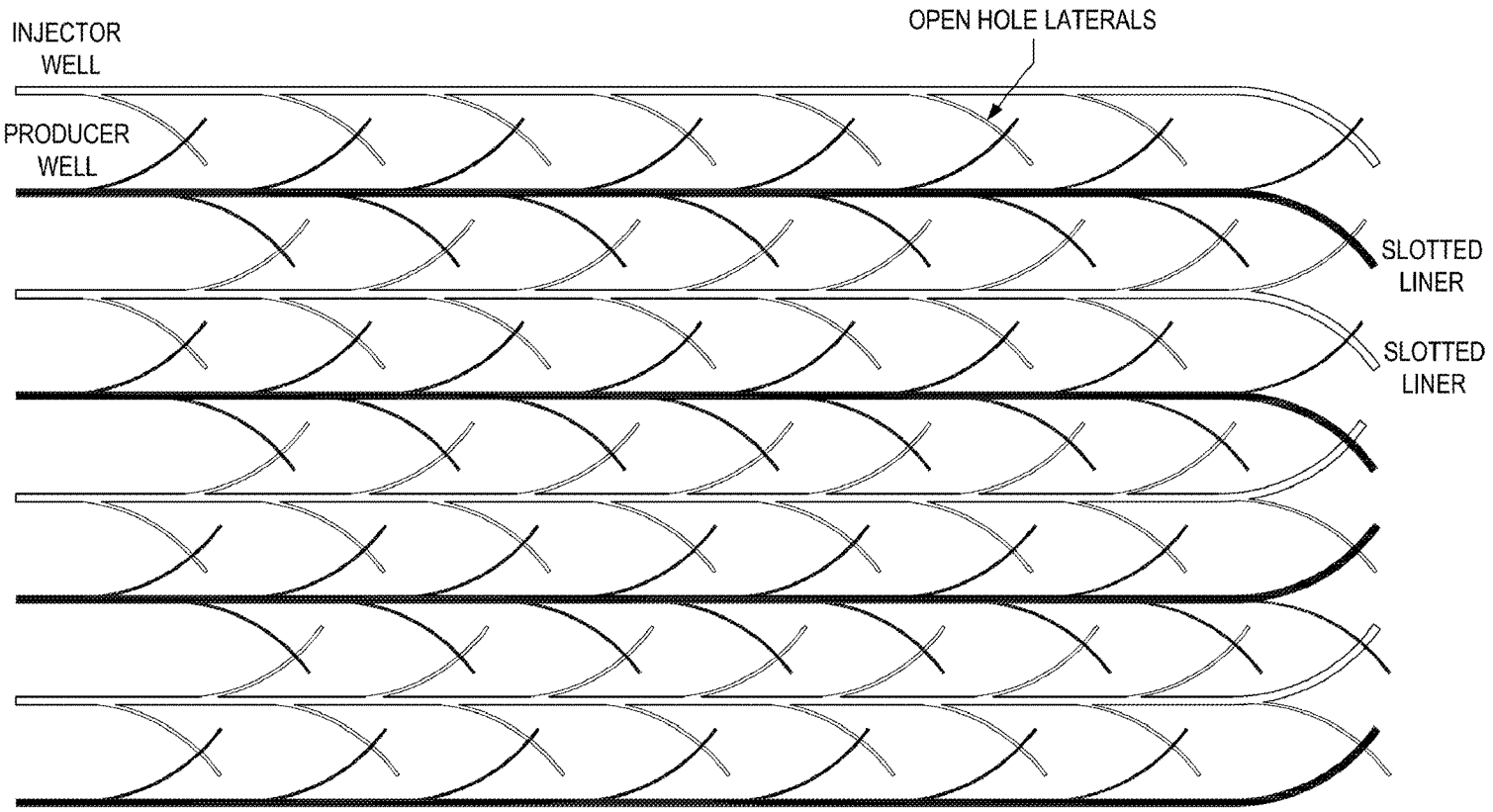

FIG. 9B provides still another variation of the embodiment in FIG. 6. In this variation there are still lined producer and injector wells, each having its fishbone open-hole ribs. The difference from FIGS. 7B and 8B is that in FIG. 9B one of the outermost wells is an injector well and the other is a producer well.

Figure 10:
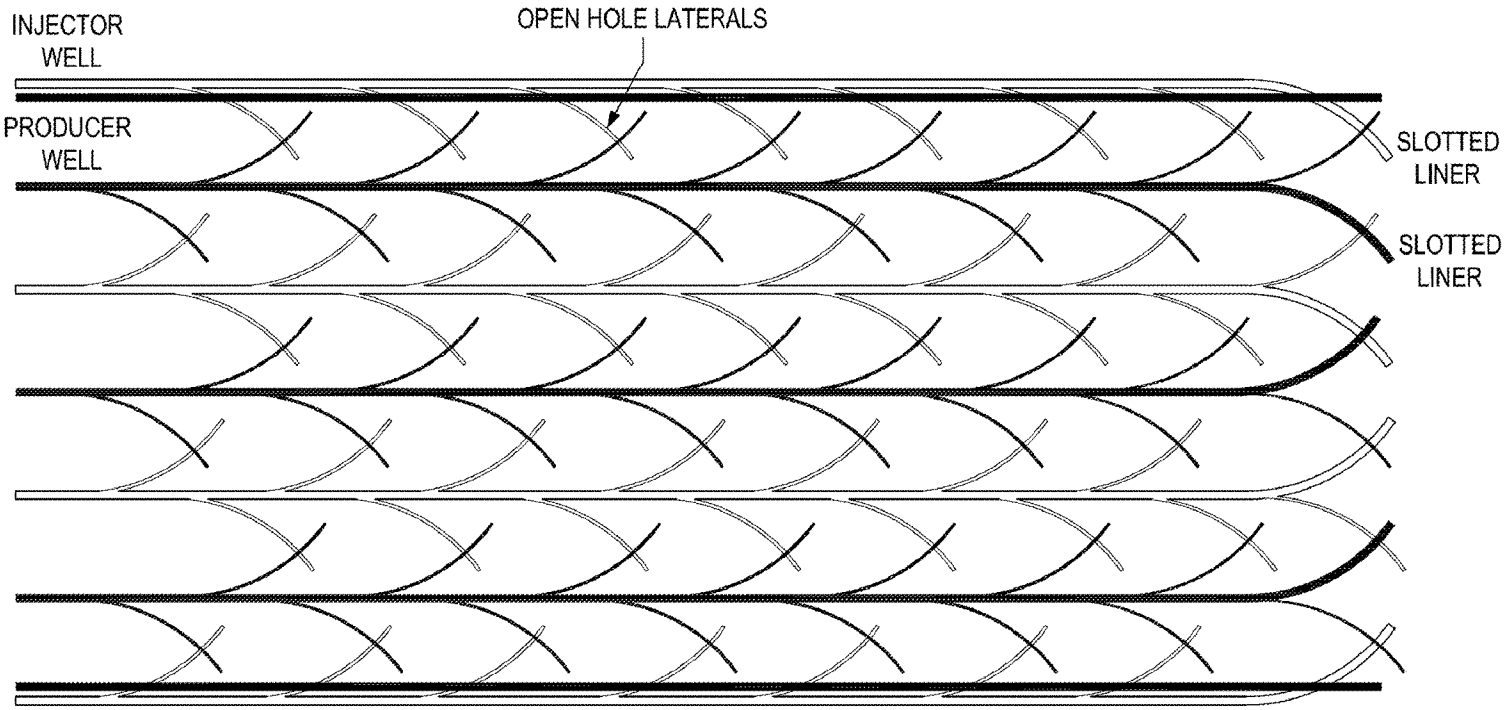

FIG. 10 provides still another variation of the embodiment in FIG. 6. In this variation the two outermost injector wells have no outwardly-extending ribs, and each of them is coupled to a conventional producer well that neither has ribs nor has a hook toward the toe. We show every injector/producer having ribs, and ribs overlapping in this figure, but it is also possible to have only producer ribs, wherein the producer ribs reach to or nearly to injectors instead. The reverse is also possible.

Figure 11:
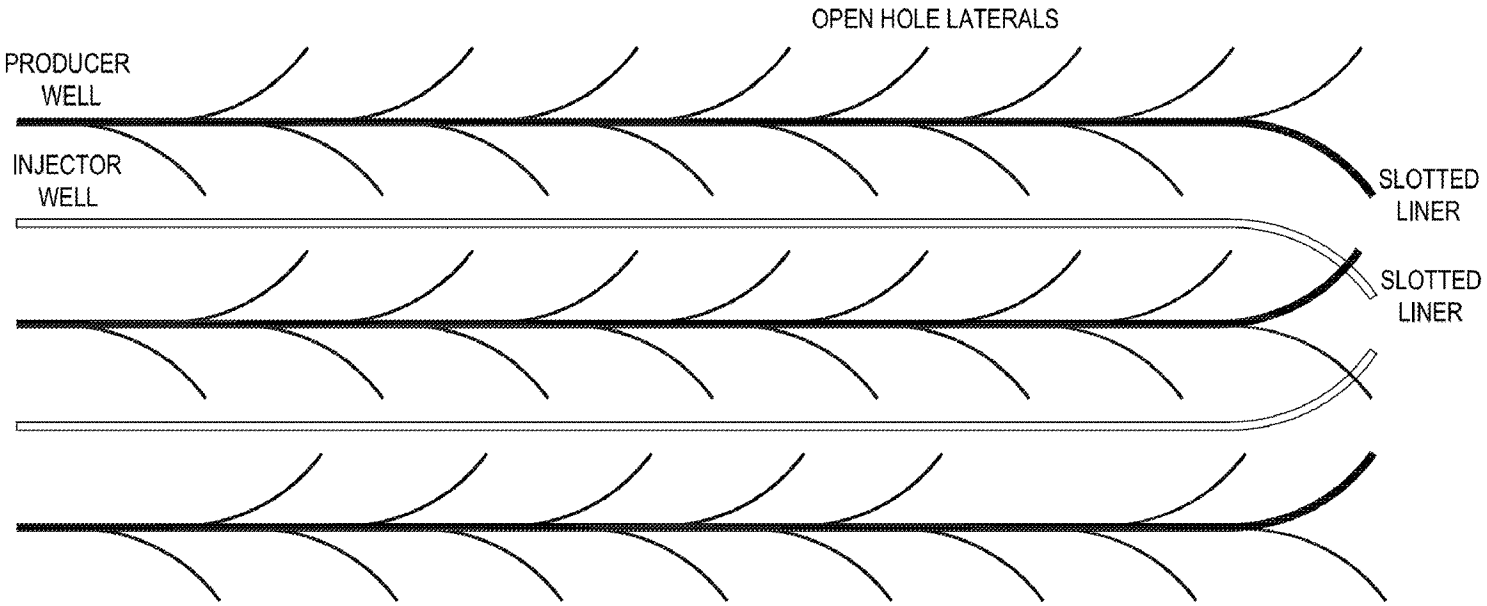
Figure 12:
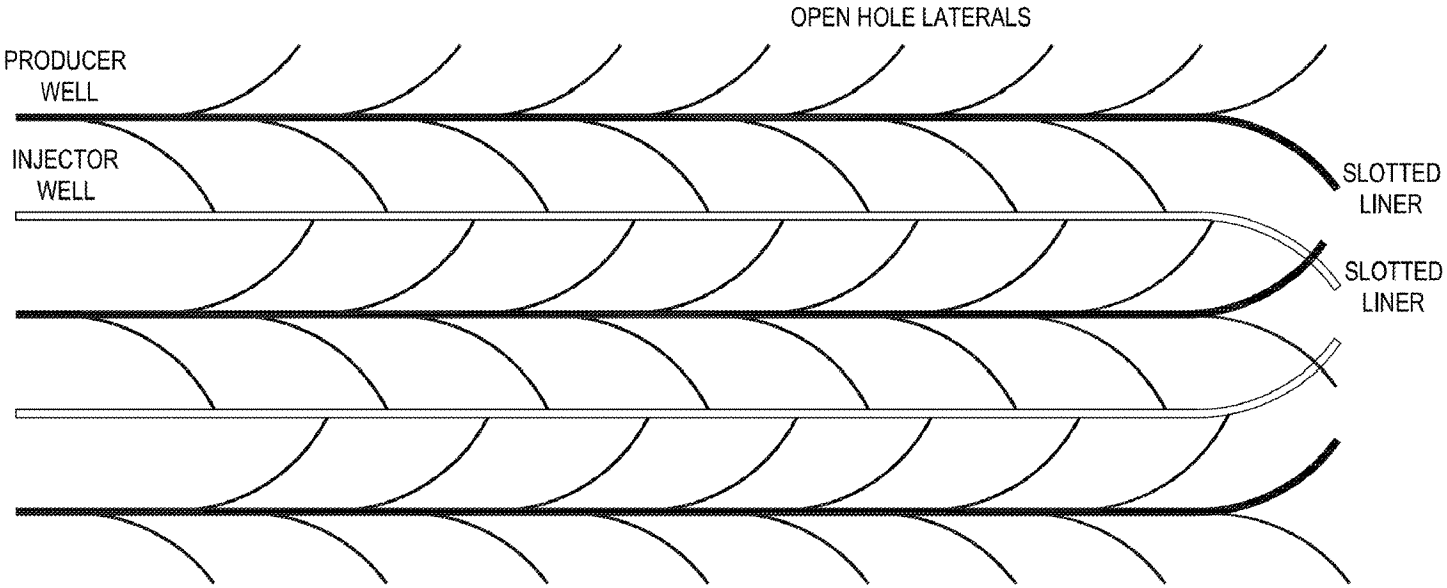

FIG. 11 shows an embodiment where only the producers have lateral wells, and FIG. 12, shows producer laterals that intersect an injector.

As illustrated above, the fishbone SAGD well configuration of this invention has several advantages over prior art. First, this fishbone SAGD well configuration can reduce or even eliminate preheat circulation that typically takes 3 months before the production begins. This is because the distance between the injector wells and the ribs of the producer wells (or vice versa) has been greatly reduced. The open-hole ribs allow better steam/condensate circulation with the producer wells. The steam injected through the injection well will condense, and the steam condensate could be produced from the fishbone production well because the open-hole ribs nearly reach, reach or intersect with the injection wells (or ribs thereof).

Once the heated fluid flows from the injection wells to the open-hole ribs of the producer wells and into the liners, a preheating effect will occur, thus eliminating the need for conventional steam circulation. This in turn reduces the equipment and surface space needed for the preheating circulation.

Also, a steam trap control that is different from those used in classical SAGD may also contribute to water and/or energy saving. The steam chamber surface area will also be greatly expanded by the ribs. A classical SAGD steam chamber has the shape of a horizontal cylinder, whereas the ribs in this fishbone SAGD will greatly accelerate the lateral growth of the steam chambers along the ribs to create centipede-like chambers, which have much more surface area-to-volume ratio. In this case the steam is contacting much more cold bitumen for a given amount of chamber volume, which translates into more mobilized oil per unit of steam chamber volume and significantly improves the thermal efficiency. All these aspects of this invention contribute to water and energy saving in a SAGD operation.

Secondly, since flow distribution control devices may be installed in the base pipe, the toe tubing strings can also be eliminated, thereby allowing the drilling of smaller diameter holes and the use of smaller liners and casings to save well cost. Similarly, well intervention can be simplified by having only one tubing string.

Additionally, less wells may be drilled in this well configuration. This means that the wellhead plumbing, manifolding, control valves and other well pad facilities can be reduced. Also, because the total number of wells drilled can be reduced, the cost of production can be brought down significantly.

Because of the simple yet effective well configuration, the drilling trajectories can be simplified, thus enabling drilling longer well length. Also because of the extensive coverage of the formation between main wellbores, the "wedge" oil that is often stranded between conventional SAGD well pairs can now be more easily and quickly developed without drilling additional infill wells, which further lowers the production cost.

The following references are incorporated by reference in their entirety for all purposes.

STALDER J. L., et al., Alternative Well Configurations in SAGD: Rearranging Wells to Improve Performance, presented at 2012 World Heavy Oil Congress [WHOC12], available online at http://www.osli.ca/uploads/files/Resources/Alternative%20Well%20Configurations%20in%20SAGD_WHOC2012.pdf OTC 16244, Lougheide, et al. Trinidad's First Multilateral Well Successfully Integrates Horizontal Openhole Gravel Packs, OTC (2004).

SPE 69700-MS, "Multilateral-Horizontal Wells Increase Rate and Lower Cost Per Barrel in the Zuata Field, Faja, Venezuela", Mar. 12, 2001.

Technical Advancements of Multilaterals (TAML). 2008. Available at http://taml-intl.org/taml-background/ http://petrowiki.org/Multilateral_completions

EME 580 Final Report: Husain, et al., Economic Comparison of Multi-Lateral Drilling over Horizontal Drilling for Marcellus Shale Field (2011), available online at http://www.ems.psu.edu/~elsworth/courses/egee580/2011/Final%20Reports/fishbone_report.pdf Hogg, C. 1997. Comparison of Multilateral Completion Scenarios and Their Application. Presented at the Offshore Europe, Aberdeen, United Kingdom, 9-12 September. SPE-38493-MS.

U.S. Pat. Nos. 8,333,245 8,376,052 Accelerated production of gas from a subterranean zone US20120247760 Dual Injection Points In SAGD US20110067858 Fishbone Well Configuration For In Situ Combustion US20120227966 In Situ Catalytic Upgrading CA2684049 INFILL WELL METHODS FOR SAGD WELL HEAVY HYDROCARBON RECOVERY OPERATIONS]

What is claimed is:

1. A well configuration for steam assisted gravity drainage (SAGD) production of hydrocarbons, the well configuration comprising:

a) a plurality of horizontal production wells at a first depth at or near the bottom of a hydrocarbon play;

b) a plurality of horizontal injection wells, each injection well laterally spaced at a distance D from an adjacent production well, wherein said distance D is at least 50 meters;

c) a plurality of open hole lateral wells originating from said plurality of horizontal production wells or said plurality of horizontal injection wells or both, wherein said plurality of open hole lateral wells cover at least 95% of said distance D.

2. The well configuration of claim 1), wherein said plurality of open hole lateral wells originate from each of said plurality of horizontal production wells and horizontal injection wells, and cover at least 98% of said distance D.

3. The well configuration of claim 1), wherein said plurality of open hole lateral wells originate from each of said plurality of horizontal production wells, and intersect with an adjacent injection well or an open hole lateral well extending from an adjacent injection well.

4. The well configuration of claim 1), wherein said plurality of open hole lateral wells originate from each of said plurality of horizontal production wells and slant upwards towards an adjacent injection well.

5. The well configuration of claim 1), wherein said plurality of open hole lateral wells are arranged in an alternating pattern.

6. The well configuration of claim 1), wherein said plurality of open hole lateral wells originate from each of said plurality of horizontal production wells and said plurality of horizontal injection wells and are arranged in an alternating pattern such that ends of lateral wells from adjacent wells overlap, such that together a pair of lateral wells covering 100% of said distance D.

7. The well configuration of claim 1), wherein each injection well is about at said first depth.

8. The well configuration of claim 1), wherein each injection well is at a lesser depth than said first depth.

9. The well configuration of claim 1), wherein said distance D is 50 meters.

10. The well configuration of claim 1), wherein said distance D is at least 100 meters.

11. The well configuration of claim 1), wherein said distance D is at least 150 meters.

12. A well configuration for steam production of hydrocarbons, the well configuration comprising:

a) a plurality of horizontal production wells;

b) a plurality of horizontal injection wells and laterally spaced apart from an adjacent production well at a first distance D, wherein said distance D is at least 50 meters;

c) a plurality of open hole lateral wells originating from said plurality of horizontal production wells or said plurality of horizontal injection wells or both, such that said lateral wells extend over at least 80% of said first distance D between adjacent wells.

13. The well configuration of claim 12), wherein said distance D is 50 meters.

14. The well configuration of claim 12), wherein said distance D is at least 100 meters.

15. The well configuration of claim 12), wherein said distance D is at least 150 meters.

16. The well configuration of claim 12), wherein said lateral wells extend over at least 90% of said first distance D between adjacent wells.

17. The well configuration of claim 12), wherein said lateral wells extend over at least 95% of said first distance D between adjacent wells.

18. An improved method of SAGD, SAGD comprising a lower horizontal production well, a higher injection well, wherein steam is injected into said injection well to mobilize oil which then gravity drains to said production well, the improvement comprising:

a) providing a plurality of horizontal production wells and a plurality of horizontal injection wells, b) each injection well spaced laterally apart by a distance of at least 50 meters from a nearest adjacent production well, c) said plurality of horizontal production wells each having a plurality of open hole lateral wells extending towards a nearest adjacent horizontal injection well, or said plurality of horizontal injection wells each having a plurality of open hole lateral wells extending towards a nearest adjacent horizontal production well, or both.

19. An improved method of SAGD, SAGD comprising a lower horizontal production well, a higher injection well, wherein steam is injected into said injection well to mobilize oil which then gravity drains to said production well, the improvement comprising providing an array of alternating horizontal production wells and horizontal injection wells laterally spaced apart by a distance of at least 50 meters and each having a plurality of open hole lateral wells extending over the distance between adjacent wells.

20. An improved method of SAGD, SAGD comprising a lower horizontal production well, a higher injection well, wherein in a preheat step, steam is injected into each of said production and injection wells for a time until fluid communication is established between said production and injection wells, wherein after the preheat step, steam is injected into said injection well to mobilize oil which then gravity drains to said production well for production, the improvement comprising:

a) providing an array of alternating lower horizontal production wells and higher horizontal injection wells, b) each adjacent well spaced laterally apart by a distance of at least 50 meters, c) said lower horizontal production wells each also having a plurality of open hole lateral wells extending upwards towards an adjacent higher horizontal injection well, and d) wherein the time of said preheat step is greatly reduced or eliminated.

21. An improved method of SAGD oil production, wherein SAGD comprises a horizontal production well and a horizontal injection well, said production and injection wells spaced vertically apart, wherein in a preheat step: a) steam is injected into each of said production and injection wells for a time until fluid communication is established between said wells, and b) steam is injected into said injection well to mobilize oil, and c) heated oil is gravity driven to said production well for production, the improvement comprising providing alternating production wells and injection wells spaced laterally apart by a distance of at least 50 meters, some of said wells each also having a plurality of open hole lateral wells extending towards a nearest adjacent well, and wherein the time of said preheat step a) is reduced by at least 95%.

* * * * *